US008439107B2

(12) United States Patent
Xu

(10) Patent No.: US 8,439,107 B2
(45) Date of Patent: May 14, 2013

(54) RETRIEVABLE TOOL WITH RATCHET LOCK FEATURE

(75) Inventor: Richard Y. Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 329 days.

(21) Appl. No.: 12/835,565

(22) Filed: Jul. 13, 2010

(65) Prior Publication Data

US 2012/0012303 A1 Jan. 19, 2012

(51) Int. Cl.
*E21B 23/00* (2006.01)

(52) U.S. Cl.
USPC ..... 166/125

(58) Field of Classification Search ..... 166/125, 166/382, 118, 206, 242.6
See application file for complete search history.

(56) References Cited

U.S. PATENT DOCUMENTS

| | | | | |
|---|---|---|---|---|
| 4,530,398 | A | 7/1985 | Greenlee et al. | |
| 4,614,233 | A | 9/1986 | Menard | |
| 4,660,637 | A | 4/1987 | McGill et al. | |
| 4,862,957 | A | 9/1989 | Scranton | |
| 4,898,245 | A | 2/1990 | Braddick | |
| 5,595,247 | A | 1/1997 | Braddick | |
| 5,941,306 | A * | 8/1999 | Quinn | 166/120 |
| RE36,526 | E | 1/2000 | Braddick | |
| 2007/0272420 | A1 * | 11/2007 | Reimert et al. | 166/387 |
| 2008/0251261 | A1 * | 10/2008 | Arce et al. | 166/387 |
| 2009/0065217 | A1 * | 3/2009 | Ross | 166/373 |

* cited by examiner

*Primary Examiner* — David Andrews
*Assistant Examiner* — Taras P Bemko
(74) *Attorney, Agent, or Firm* — Steve Rosenblatt

(57) ABSTRACT

A releasable locking system for a subterranean tool uses a split housing for a body lock ring that in one mode is retained for its normal locking function by a setting sleeve. The setting sleeve holds the potential energy in the housing that would otherwise cause the housing to grow radially and away from a locking function. The locking is defeated as a surrounding setting sleeve with a recess is moved to juxtapose the recess with the segmented housing allowing the housing to spring into the recess and away from lock ring engagement that previously maintained the locked position. The tool can be released and removed to a surface location.

10 Claims, 4 Drawing Sheets

RETRIEVABLE TOOL WITH RATCHET LOCK FEATURE

FIELD OF THE INVENTION

The field of the invention is tools that set and hold the set position with a ratchet lock and more particularly where the locked set position can be unlocked by removing support for a split housing that is against a ratchet lock ring.

BACKGROUND OF THE INVENTION

FIG. 1 illustrates a body lock ring 10 positioned outside a mandrel 12 with an outer housing 14 surrounding the lock ring 10. Arrow 16 indicates an applied force to the outer housing 14 with the mandrel 12 held fixed. In that situation the housing 14 can move down in the direction of arrow 16 and take the lock ring 10 with it. This is because the thread 18 orientation with respect to the orientation of thread 20 on the lock ring 10 is such that in the direction on movement of housing 14 indicated by arrow 16 the threads 18 and 20 are oriented for only tandem movement without ratcheting over each other. However, thread 22 on the opposite side of the lock ring 10 from thread 20 is oriented with respect to thread 24 on the mandrel 12 so that tandem motion of the housing 14 with the lock ring 10 can take place because the thread 22 ratchets over thread 24 using the clearance space 26 available on opposed sides of the lock ring 10 to allow the actuation of the tool with the force in the direction of arrow 16. Such a force and a movement of the housing 14 can be used for example to set slips and sealing elements on a packer or bridge plug or open or close a port as some possible examples. The point being that the lock ring 10 allows relative movement in one direction and locks in that movement in the opposite direction. This locking feature is seen in FIG. 2 where after setting and removing the setting force represented by arrow 16 there is a reaction force in the opposite direction of arrow 28. Now thread 18 drives thread 20 for tandem attempted movement in the direction of arrow 28 but this movement is stopped by the inability of thread 22 to ratchet over thread 24 when the lock ring 10 is pushed in the direction of arrow 28. Normally, this locked position is held. If it is desired to remove the tool such as a packer or a bridge plug, then the tool can be milled out or its mandrel cut into pieces to relieve the grip of lock ring 10.

In one prior design the lock ring is held in an operating position to ratchet lock and is released when a surrounding sleeve held in position by a lock ring which when undermined by sleeve movement allows a release of the lock ring assembly 42,302 and 312 for a release of the ratchet as shown when comparing FIGS. 14 and 23 of U.S. Pat. No. 5,595,247. This patent was reissued as RE 36,526 and has a related case of U.S. Pat. No. 4,898,245.

Other designs features lock segments that hold two members together until the segments have support removed that allows separation of the two members that were formerly held together. Some examples of such designs are items 40 and 62 in FIG. 15b of U.S. Pat. No. 4,530,398; items 42 and 100 in FIG. 1 of U.S. Pat. No. 4,614,233; items 142, 144 and 136 in FIG. 4 of U.S. Pat. No. 4,862,957 which has a related case of U.S. Pat. No. 4,660,637.

The present invention addresses this issue with a design that allows a split housing to spring outwardly into a recess that is presented opposite the split housing as the setting sleeve is picked up. The housing has the ability to use the locked in spring force to get into the recess far enough so that the gripping teeth on the housing retreat sufficiently from the lock ring to unset the tool and remove it from a subterranean location. This can be done while avoiding damage to the major components. These and other features of the present invention will be better understood by those skilled in the art by a review of the description of the preferred embodiment and the associated drawings while understanding that the full scope of the invention is to be found in the appended claims.

SUMMARY OF THE INVENTION

A releasable locking system for a subterranean tool uses a split housing for a body lock ring that in one mode is retained for its normal locking function by a setting sleeve. The setting sleeve holds the potential energy in the housing that would otherwise cause the housing to grow radially and away from a locking function. The locking is defeated as a surrounding setting sleeve with a recess is moved to juxtapose the recess with the segmented housing allowing the housing to spring into the recess and away from lock ring engagement that previously maintained the locked position. The tool can be released and removed to a surface location.

DETAILED DESCRIPTION OF THE PREFERRED EMBODIMENT

Figure 1:
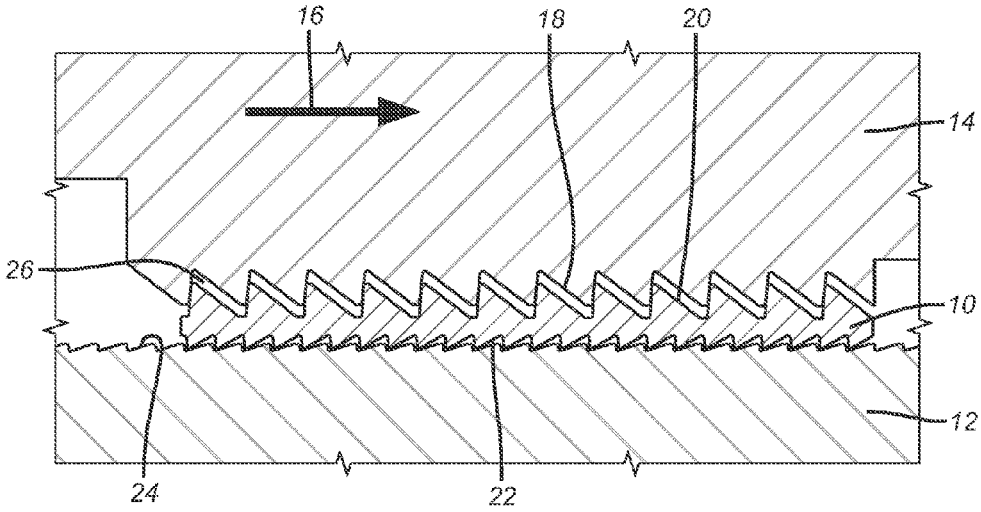
(PRIOR ART) FIG. 1
FIG. 1 is a prior art lock ring design during the setting operation for the tool.
Figure 2:
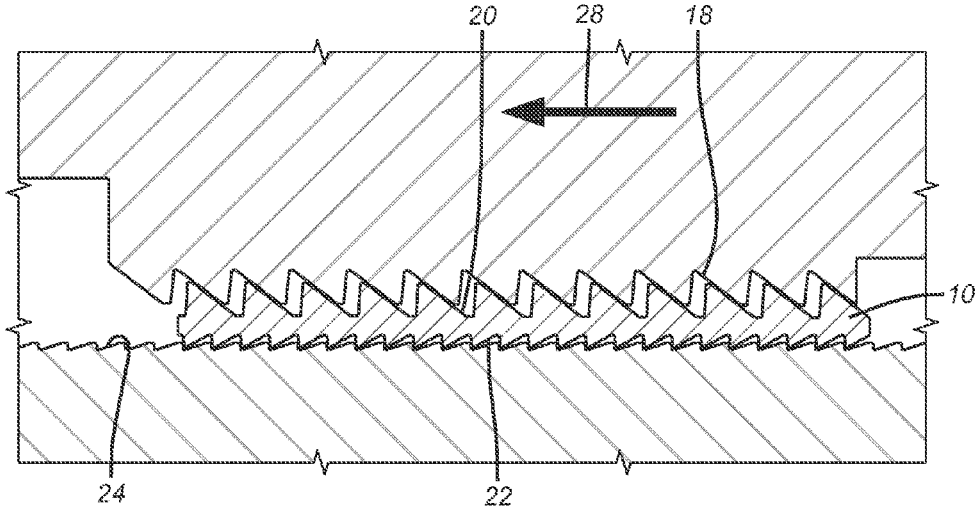
(PRIOR ART) FIG. 2
FIG. 2 is the view of FIG. 1 with the tool locked in its set position.
Figure 3:
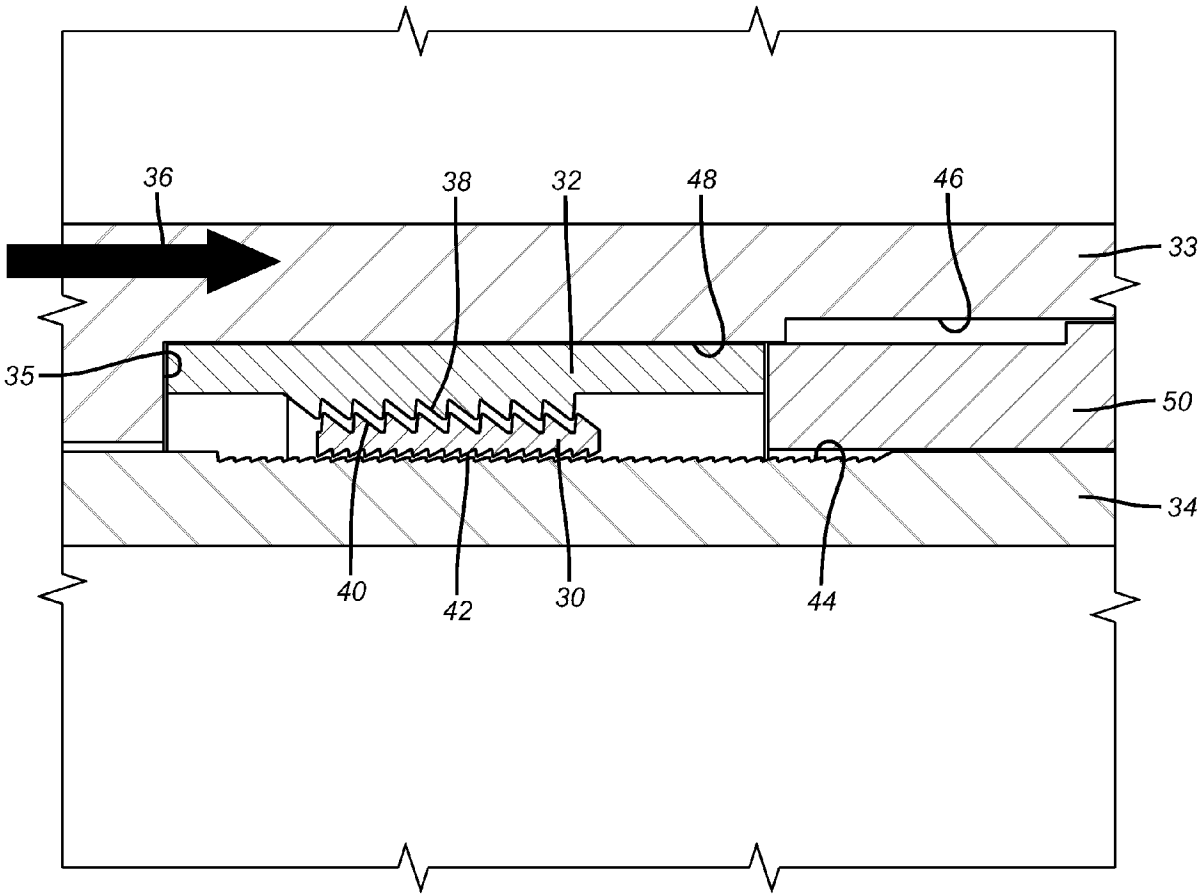
FIG. 3 is a view of the present invention as the tool is actuated.

The present invention is shown in the setting the tool position in FIG. 3. The body lock ring 30 is preferably a split ring located between the housing 32 and the mandrel 34. A setting sleeve 33 overlays the housing 32. Arrow 36 represents a setting force that is applied, with the mandrel 34 held in position, on setting sleeve 33 that takes with it the housing 32 due to shoulder 35. Thread 38 on the housing 32 carries with it thread 40 of the lock ring 30 because the shapes of these two threads prevent relative ratcheting in the direction of arrow 36. On the other hand, thread 42 on the lock ring 30 can ratchet over thread 44 of the mandrel 34 when the lock ring is urged in the direction of arrow 36 by a force applied to the housing 32. Setting sleeve 33 has a recess 46 on an interior wall 48 that in the FIG. 3 position is axially offset from the housing 32. When the setting force represented by arrow 36 is released the set of the tool will be locked as movement in the direction in reverse to arrow 36 cannot happen, as shown in FIG. 5.

Figure 5:
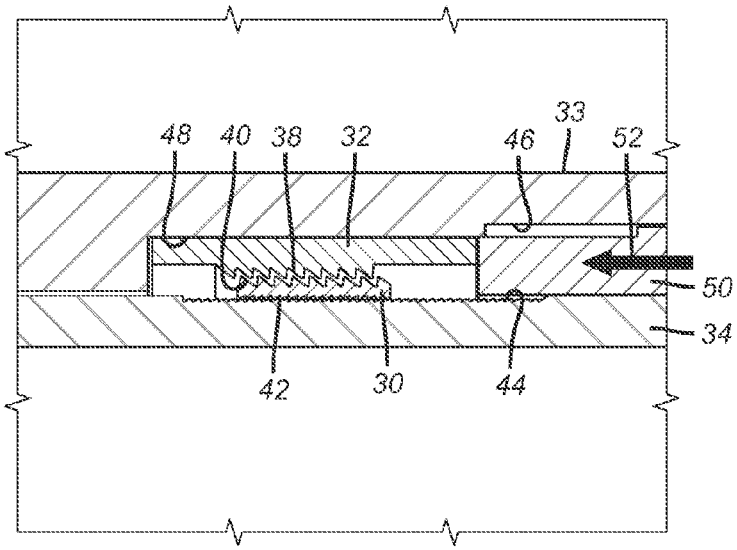
FIG. 5 is a view of the assembly in the locked position of the tool.

In FIG. 5 the setting force is released and a reaction force through the sleeve 50 is now applied in the direction of arrow 52. The housing 32 and the lock ring 30 have to move in tandem in the direction of arrow 52 due to the configuration of threads 38 and 40. However, threads 42 and 44 are configured to prevent ratcheting of the lock ring 30 over the mandrel 34 so that nothing moves in response to the reaction force from the tool after the set force is removed and the reaction force continues in the direction of arrow 52.

Figure 4:
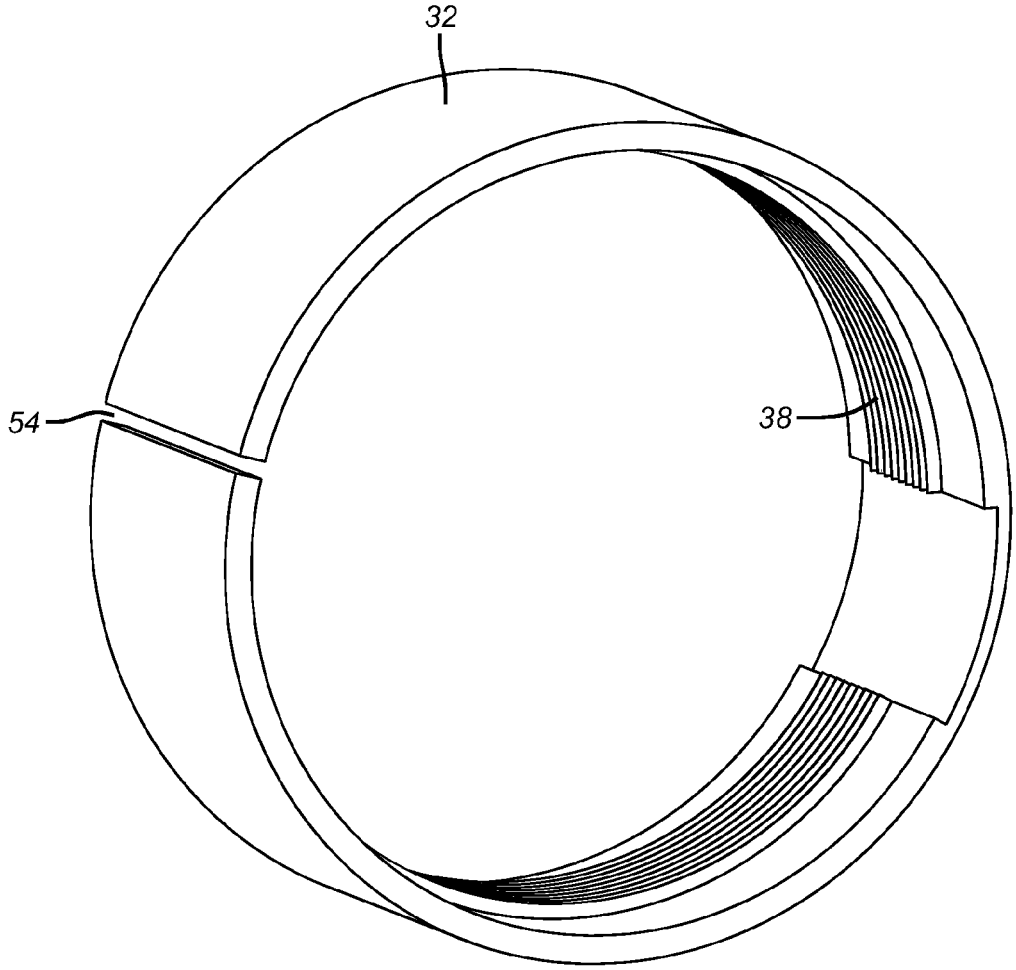
FIG. 4 is a perspective view of the split lock ring of the present invention.

However, now a release is possible when the setting sleeve 33 is raised by a release tool (not shown) so that the recess 46 is opposite the housing 32. As shown in FIG. 4 the housing 32 is a split ring with a gap 54 so that the potential energy force that was stored in the housing in FIG. 3 when the housing 32 was opposed to surface 48 is liberated when the recess 46 is put into juxtaposition with the housing 32. As a result the housing springs out to a larger inside dimension enough to take thread 38 away from thread 40 such that the reaction force from the tool represented by arrow 52 is sufficient to unlock the tool to a configuration where it can be removed from the subterranean location to the surface.

Figure 6:
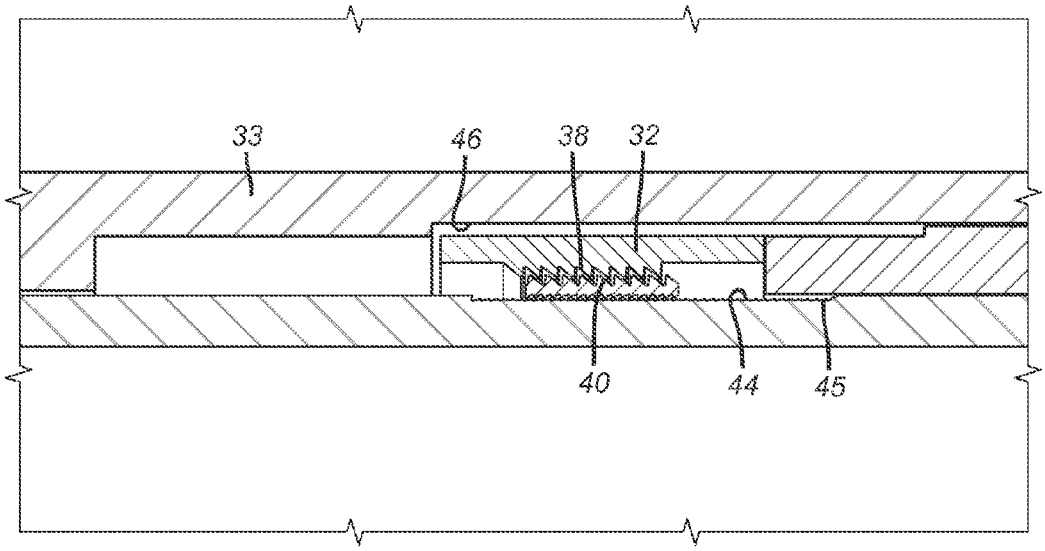
FIG. 6 is the released view with the housing recess aligned with the split lock ring.

Those skilled in the art will appreciate that sleeves 33 and 50 move in tandem during the setting while housing 32 is pushed by shoulder 35 and takes the lock ring 30 with it. The assembly of housing 32 and lock ring 30 can move down with respect to mandrel 34 because the thread 42 can ratchet down the thread 44 during the setting shown in FIG. 3. As soon as the setting force is removed there is a reaction force in the opposite direction caused for example if a sealing element has been longitudinally compressed. Since the sleeves 33 and 50 are at this time held together for tandem movement, the reaction force in the direction of arrow 52 is transmitted to the housing 32 that is still locked to the mandrel 34 in the view of FIG. 5. The force on housing 32 tries to raise it in the direction of reaction force 52 but the interaction of thread 38 and 40 does not permit ratcheting in the direction of arrow 52 so that an upward force in the direction of arrow 52 is in turn transmitted through the lock ring 30 to its thread 42 and into the thread 44 of the mandrel 34. Since in the direction of arrow 52 the thread 42 cannot ratchet over the thread 44 the entire assembly is locked to the mandrel 34 as long as surface 48 is juxtaposed behind the split lock ring 30. When a pull of a predetermined force is applied to sleeve 33 there is a release that occurs between sleeve 33 and sleeve 50 such as by breaking a shear pin so that there is initial independent movement of sleeve 33 with respect to sleeve 50 to put the recess 46 opposite the housing 32. Now the reaction force from sleeve 50 is able to push the housing 32 in tandem with the sleeve 33 as the ratcheting of thread over the stationary thread 40 forces the housing 32 apart at the split 54. While this happens the lock ring 30 is still stationary until enough outward radial movement of housing 32 into recess 46 occurs to allow threads 38 and 40 to ratchet past each other at which point there is no support for the lock ring 30 and depending on the weight of lock ring 30 it may either remain in position close to its FIG. 6 position or, more likely, it can fall to a travel stop defined by the lower end 45 of thread 44.

The present invention uses a split housing around the lock ring that can release by simply making it possible for the housing to change dimension. The lock system itself needs no shear pins to effectuate a release. With just two components the ratchet locking can occur and defeat of the locked position occurs by a defeat of one of the two components used for the locking. Doing it this way removes the need for complex systems of internal support surfaces as well as additional components to effectuate the release as shown in U.S. Pat. No. 5,595.247.

The above description is illustrative of the preferred embodiment and many modifications may be made by those skilled in the art without departing from the invention whose scope is to be determined from the literal and equivalent scope of the claims below.

I claim:

1. A locking system for a subterranean tool, comprising:

a lock ring having an inner and an outer threaded surfaces, said lock ring movably mounted over a tool mandrel having an exterior mandrel thread facing said inner threaded surface of said lock ring so that relative movement between said lock ring and said mandrel can be selectively locked in;

a split housing mounted over said lock ring having an inner surface thread facing said outer threaded surface of said lock ring;

a movable outer component to selectively hold said split housing against said lock ring to enable retention of said split housing to said mandrel and to release said split housing to move away from said lock ring to defeat the locking system by positioning in alignment with said split housing a recess formed on an inner surface of said movable outer component.

2. The system of claim 1, wherein:

said outer component, in response to an applied force, moves said split housing in tandem with said lock ring with respect to said mandrel in a first direction as said lock ring inner thread ratchets over said exterior mandrel thread.

3. The system of claim 2, wherein:

said recess remains misaligned from said split housing during said tandem movement.

4. The system of claim 3, wherein:

said lock ring holds the position said lock ring had when force applied to said outer component is removed and a reaction force in a second direction from the tool is applied to said lock ring.

5. The system of claim 4, wherein:

said reaction force from the tool is applied to said lock ring from a tool sleeve on the tool that is selectively retained to said outer component.

6. The system of claim 5, wherein:

release of said outer component from said tool sleeve allows said recess to be positioned in alignment with said split housing.

7. The system of claim 6, wherein:

said split housing moves radially into said recess a sufficient distance to separate said inner surface thread of said split housing from said outer surface thread of said lock ring.

8. The system of claim 7, wherein:

said split housing moves radially due to a release of potential energy formerly retained in said split housing when said recess was misaligned with said split housing.

9. The system of claim 8, wherein:

said lock ring comprises at least one gap.

10. The system of claim 9, wherein:

the tool comprises a packer or a bridge plug.

* * * * *